US009854348B2

(12) United States Patent
Naylor-Warren

(10) Patent No.: US 9,854,348 B2
(45) Date of Patent: Dec. 26, 2017

(54) FLEXIBLE CONFORMAL CUSHIONED HEADPHONES

(71) Applicant: Nikola Taisha Naylor-Warren, Arnold, PA (US)

(72) Inventor: Nikola Taisha Naylor-Warren, Arnold, PA (US)

( * ) Notice: Subject to any disclaimer, the term of this patent is extended or adjusted under 35 U.S.C. 154(b) by 0 days.

(21) Appl. No.: 15/279,633

(22) Filed: Sep. 29, 2016

(65) Prior Publication Data

US 2017/0289665 A1 Oct. 5, 2017

Related U.S. Application Data

(60) Provisional application No. 62/390,616, filed on Apr. 4, 2016.

(51) Int. Cl.
*H04R 1/10* (2006.01)

(52) U.S. Cl.
CPC ..... *H04R 1/105* (2013.01); *H04R 1/1066* (2013.01)

(58) Field of Classification Search
CPC ..... H04R 1/10; H04R 1/1041; H04R 1/105; H04R 1/12
USPC ..... 345/156; 348/838; 381/73.1, 74, 370, 381/371, 374, 378, 379, 380, 383, 418, 381/376, 384, 300, 381; 2/68; 379/430; 434/113; 181/129
See application file for complete search history.

(56) References Cited

U.S. PATENT DOCUMENTS

| | | | | |
|---|---|---|---|---|
| 4,403,120 | A * | 9/1983 | Yoshimi | H04R 1/225 181/129 |
| 4,989,271 | A | 2/1991 | Sapiejewski | |
| 5,303,426 | A | 4/1994 | Jones | |
| 5,684,879 | A * | 11/1997 | Verdick | H04R 1/1075 381/300 |
| 5,881,390 | A | 3/1999 | Young | |
| 6,385,325 | B1 * | 5/2002 | Nageno | H04R 1/1066 381/370 |
| 6,603,863 | B1 * | 8/2003 | Nagayoshi | H04R 1/1066 381/370 |
| 6,629,579 | B1 | 10/2003 | Hasegawa | |
| 6,698,028 | B2 | 3/2004 | Daw | |
| 6,724,906 | B2 | 4/2004 | Nasken et al. | |
| 6,731,771 | B2 | 5/2004 | Cottrell | |
| 6,788,797 | B2 * | 9/2004 | Kim | H04R 1/1008 381/309 |
| 7,172,052 | B2 * | 2/2007 | Lenhard-Backhaus | H04R 1/1066 181/129 |
| 7,245,735 | B2 | 7/2007 | Han | |
| 7,571,503 | B2 | 8/2009 | Gabriel | |
| 8,098,873 | B2 * | 1/2012 | Furuya | H04R 1/1066 381/370 |

(Continued)

FOREIGN PATENT DOCUMENTS

WO 2010015030 2/2010

*Primary Examiner* — Gerald Gauthier
(74) *Attorney, Agent, or Firm* — Ballard Spahr LLP

(57) ABSTRACT

Headphones designed for comfort have a flexible, deformable armature which supports speakers. An elastic strip attached to the armature biases it into a curved shape. The armature and speakers are surrounded by a fabric sheath. A layer of flexible, resilient material such as polyester foam is interposed between the armature and the sheath for cushioning. The speakers are held in pockets positioned in the sheath at opposite ends of the armature.

20 Claims, 4 Drawing Sheets

(56) References Cited

U.S. PATENT DOCUMENTS 8,208,672 B2 * 6/2012 Nageno ..... H04R 5/0335 381/370
8,306,237 B2 * 11/2012 Connor ..... A61M 21/0094 381/376
8,325,961 B2 * 12/2012 Le Gette ..... H04R 1/06 381/301
8,363,877 B2 * 1/2013 Morisawa ..... H04R 5/0335 2/209
8,452,039 B2 5/2013 Wright
8,532,324 B2 * 9/2013 Oosato ..... H04R 1/1008 381/370
8,565,468 B2 * 10/2013 Ito ..... H04R 1/105 381/370
8,605,935 B1 * 12/2013 Huang ..... H04R 1/105 381/374
8,625,835 B2 1/2014 Gotlieb
8,818,000 B2 8/2014 Andrea
8,937,248 B2 1/2015 Huang
9,031,275 B2 5/2015 Brogsgaard
9,143,854 B2 * 9/2015 Alao ..... H04R 1/105
9,185,483 B2 11/2015 Solomon et al.
2001/0010727 A1 * 8/2001 Urwyler ..... H04R 1/1033 381/384
2001/0017925 A1 * 8/2001 Ceravolo ..... H04M 1/05 381/370
2002/0076040 A1 * 6/2002 Sung ..... H04M 1/05 379/430
2003/0044038 A1 * 3/2003 Shirata ..... H04R 1/105 381/381
2003/0091209 A1 * 5/2003 Ito ..... H04R 5/0335 381/379
2003/0156730 A1 * 8/2003 Wu ..... H04R 1/1066 381/381
2003/0169898 A1 * 9/2003 Arasawa ..... H04R 1/1066 381/383
2003/0210801 A1 * 11/2003 Naksen ..... H04R 1/1066 381/370
2004/0005071 A1 * 1/2004 Siskin ..... A61F 11/14 381/378
2005/0220317 A1 * 10/2005 Hsiang ..... H04R 1/1016 381/371
2005/0244027 A1 * 11/2005 Kaulfuss ..... H04R 5/0335 381/383
2006/0062417 A1 * 3/2006 Tachikawa ..... H04R 1/1066 381/378
2007/0263896 A1 * 11/2007 Chen ..... H04R 1/105 381/381
2008/0187151 A1 * 8/2008 McClenon ..... H04R 1/12 381/74
2008/0253603 A1 * 10/2008 Huang ..... H04R 1/1091 381/374
2009/0180658 A1 * 7/2009 Dolberg ..... H04R 1/1033 381/376
2010/0020252 A1 * 1/2010 Otsuki ..... H01M 10/44 348/838
2010/0034414 A1 * 2/2010 Miyata ..... H04R 5/0335 381/374
2011/0002497 A1 * 1/2011 Fukuma ..... H04R 5/0335 381/374
2012/0195455 A1 * 8/2012 Chiba ..... H04R 1/1091 381/374
2013/0115579 A1 * 5/2013 Taghavi ..... G06F 3/016 434/113
2013/0195307 A1 * 8/2013 Mizuno ..... H04R 1/1091 381/374
2013/0243236 A1 * 9/2013 Chamness ..... H04R 5/0335 381/378
2013/0322676 A1 * 12/2013 Araki ..... H04R 1/1041 381/374
2014/0177897 A1 * 6/2014 Baik ..... H04R 1/12 381/370
2014/0185855 A1 * 7/2014 Lin ..... H04R 1/1091 381/383
2014/0211976 A1 * 7/2014 Brunner ..... H04R 1/1066 381/374
2014/0241561 A1 * 8/2014 Motosugii ..... H04R 5/0335 381/379
2014/0259265 A1 * 9/2014 Schermerhorn ..... A42B 1/12 2/68
2014/0259423 A1 9/2014 Farck
2015/0346810 A1 * 12/2015 Urbach ..... G06F 3/011 345/156
2016/0100237 A1 * 4/2016 Blouse ..... H04R 1/105 381/378
2016/0150311 A1 * 5/2016 Bremyer ..... H04R 1/288 381/371
2016/0198266 A1 * 7/2016 Baek ..... H04R 11/02 381/418
2016/0212519 A1 * 7/2016 Henderson ..... H04R 5/0335
2017/0118552 A1 * 4/2017 White ..... H04R 5/0335
2017/0201820 A1 * 7/2017 Inoue ..... H04R 1/1041
2017/0289665 A1 * 10/2017 Naylor-Warren .... H04R 1/1066

* cited by examiner

FLEXIBLE CONFORMAL CUSHIONED HEADPHONES

CROSS REFERENCE TO RELATED APPLICATION

This application is based upon and claims priority to U.S. Provisional Application No. 62/390,616 filed Apr. 4, 2016 and hereby incorporated by reference herein.

FIELD OF THE INVENTION

This invention relates to headphones for converting electrical signals to sounds.

BACKGROUND

Headphones used to convert electrical signals into sounds find widespread use, for example, for private listening to music, news and the like. When used in conjunction with a microphone headphones permit two way communication, for example, using cellular telephones.

Headphones are intended to be worn on the head of the user and for them to be truly "hands free" must reliably maintain their position. Comfort is also a factor, especially if headphones are to be worn for extended periods. Furthermore, the headphones should be adjustable to securely fit a wide range of head sizes and shapes as well as a wide variety of wearing styles. For example, many individuals use headphones to induce sleep, and thus it is important for headphones to be comfortable and maintain their position on the head of the wearer when the wearer is lying down with their head on a pillow. The design choices found in prior art headphones are a compromise which favor some requirements, for example, characteristics that help the headphones maintain their position, over other requirements, such as comfort and adjustability. There is clearly a need for headphones having characteristics which strike a more balanced design for the considerations of adjustability and comfort.

SUMMARY

The invention concerns headphones. In one example embodiment the headphones comprise an elongate, flexible, deformable armature. An elastic strip is attached lengthwise along the armature. At least a first speaker is supported by the armature. In a specific example embodiment the armature comprises a deformable metal core. By way of further example a sheath surrounds the armature. The sheath comprises a flexible substrate. The substrate may comprise a fabric. A layer of resilient, flexible material may be positioned between the sheath and the armature. By way of example the resilient, flexible material comprises polymer foam.

In an example embodiment the first speaker comprises a wireless receiver and a power source. A further example embodiment comprises a second speaker supported by the armature. Another example embodiment comprises an electrical connector. First and second electrical conductors connect the first and second speakers to the electrical connector.

In a particular example embodiment the armature has first and second ends oppositely disposed. The first speaker is supported by the armature at the first end thereof and the second speaker is supported at the second end thereof. By way of further example the armature forms respective first and second loops at the first and second ends. In an example embodiment, first and second pockets are formed in the sheath. The first and second pockets are respectively positioned adjacent to the first and second ends of the armature. The first speaker is received in the first pocket, the second speaker is received in the second pocket in this embodiment.

The invention further encompasses headphones for supporting a speaker comprising, by way of example, an elongate, flexible, deformable armature. An elastic strip is attached lengthwise along the armature. A flexible sheath surrounds the armature. A specific example embodiment further comprises a layer of resilient, flexible material positioned between the sheath and the armature. In an example embodiment, a first speaker is supported by the armature. By way of example the first speaker is supported between a layer of resilient flexible material and the sheath. Another example embodiment comprises a second speaker supported by the armature. The first speaker is positioned at a first end of the armature; the second speaker is positioned at a second end of the armature in this example. By way of further example the armature forms respective first and second loops at respective first and second ends of the armature. Another embodiment comprises first and second pockets formed in the sheath. The first and second pockets are respectively positioned adjacent to respective first and second ends of the armature in an example embodiment.

DETAILED DESCRIPTION

Figure 1:
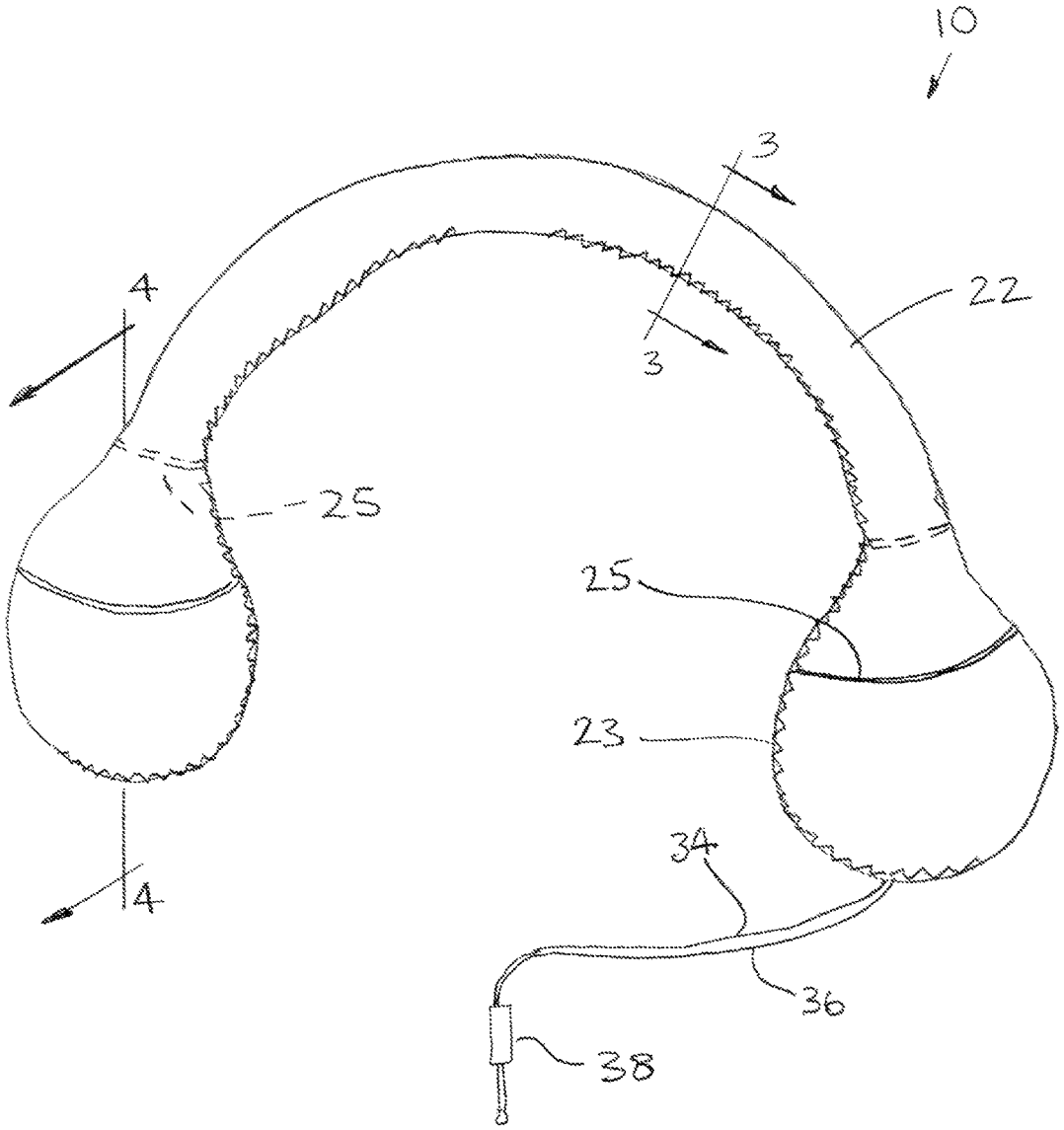
FIG. 1 is a plan view of an example embodiment of headphones according to the invention.
Figure 2:
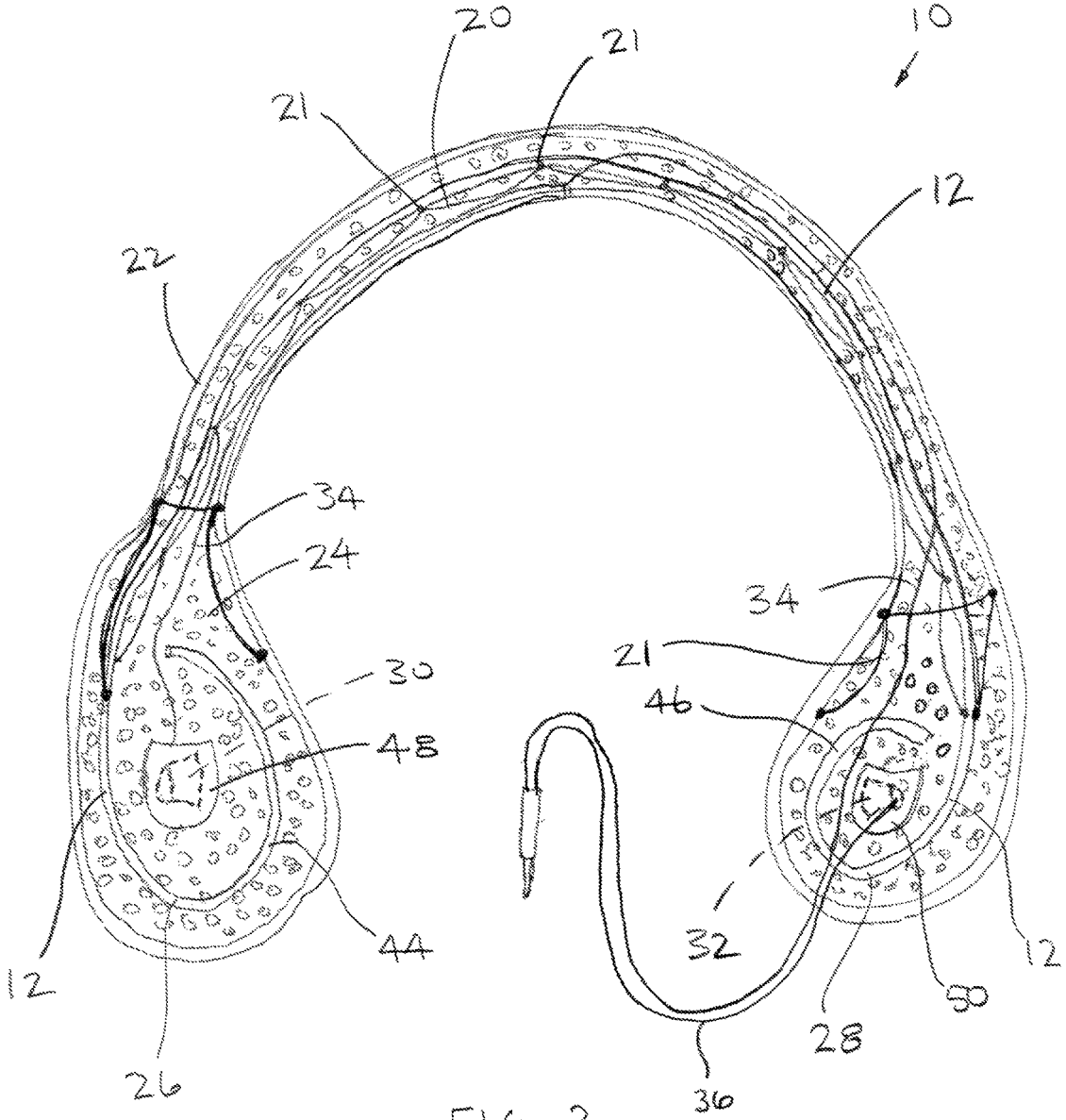
FIG. 2 is a cross sectional plan view of the headphones shown in FIG. 1.
Figure 3:
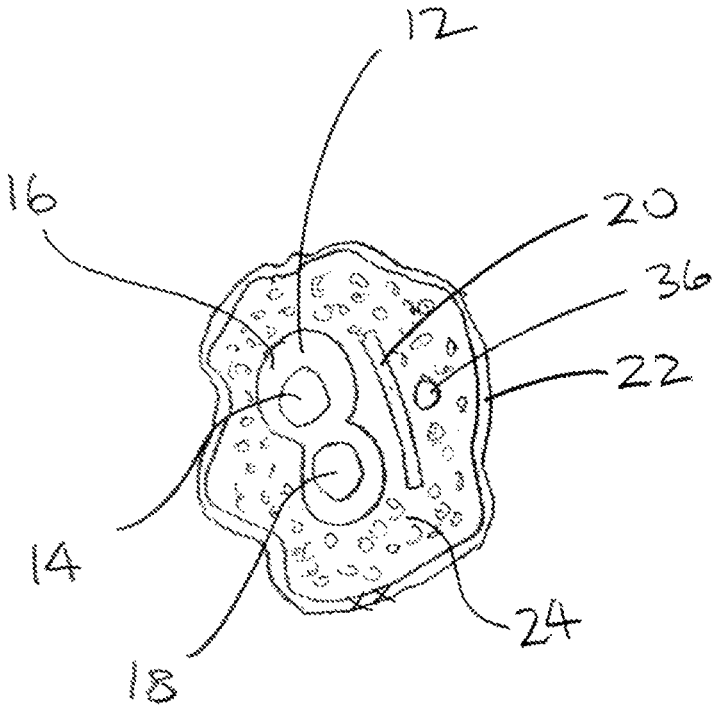
FIG. 3 is a cross sectional view taken at line 3-3 of FIG. 1.

FIGS. 1 and 2 show an example embodiment of a set of flexible, conformal, cushioned headphones 10 according to the invention. As shown in cross section in FIG. 2, headphones 10 comprise an elongate, flexible, deformable armature 12. An example armature 12, as shown in FIG. 3, comprises a deformable metal core 14 surrounded by a flexible sleeve 16. In a practical example the metal core 14 may comprise one or more copper wires 18, and the sleeve 16 may comprise a polymer insulating layer. Copper is advantageous because it readily deforms plastically without failing and can be deformed many times to adapt the headphones to a desired shape. As shown in FIG. 2, an elastic strip 20 is attached lengthwise along the armature 12. Elastic strip 20 may comprise woven elastic yarns attached, either continuously to or at a plurality of points 21, along the length of the armature 12. Elastic strip 20 applies a compression force to the armature 12 to bias it into a curved configuration. The armature 12 remains flexible however, and can deform to conform comfortably to the shape a wearer's head, the elastic strip 20 providing the biasing force so that the headphones remain securely in place on the wearer's head. The elastic strip 20 may be attached to the armature 12 by stitching, cinching, heat fusing, and adhesives to cite a few examples. U-shaped elastic anchors 21 are attached between armature 12 and a flexible sheath 22 which surrounds the armature. The U-shaped anchors are also formed of an elastic strip and provide guidance determining how the headphones 10 conform to the ears of a wearer.

As shown in FIGS. 1-3, flexible sheath 22 surrounds the armature 12 and its elastic strip 20. Sheath 22 comprises a flexible substrate, for example, a fabric such as felt, or woven or knitted fabrics of cotton, wool or polyester, as well as blends of synthetic and natural fibers. It is advantageous that the sheath 22 be formed of a material which is comfortable to wear against the skin. The fabric forming the sheath 22 may be stitched together, as shown at 23, to form a desired shape as shown in FIG. 1. Openings 25 may be located at various positions in the sheath 22 to provide access to the interior of the headphones 10. The openings in this example embodiment comprise flaps secured in a closed position by hook and loop fasteners and permit insertion and adjustment of internal components, such as speakers and wires described below.

Figure 4:
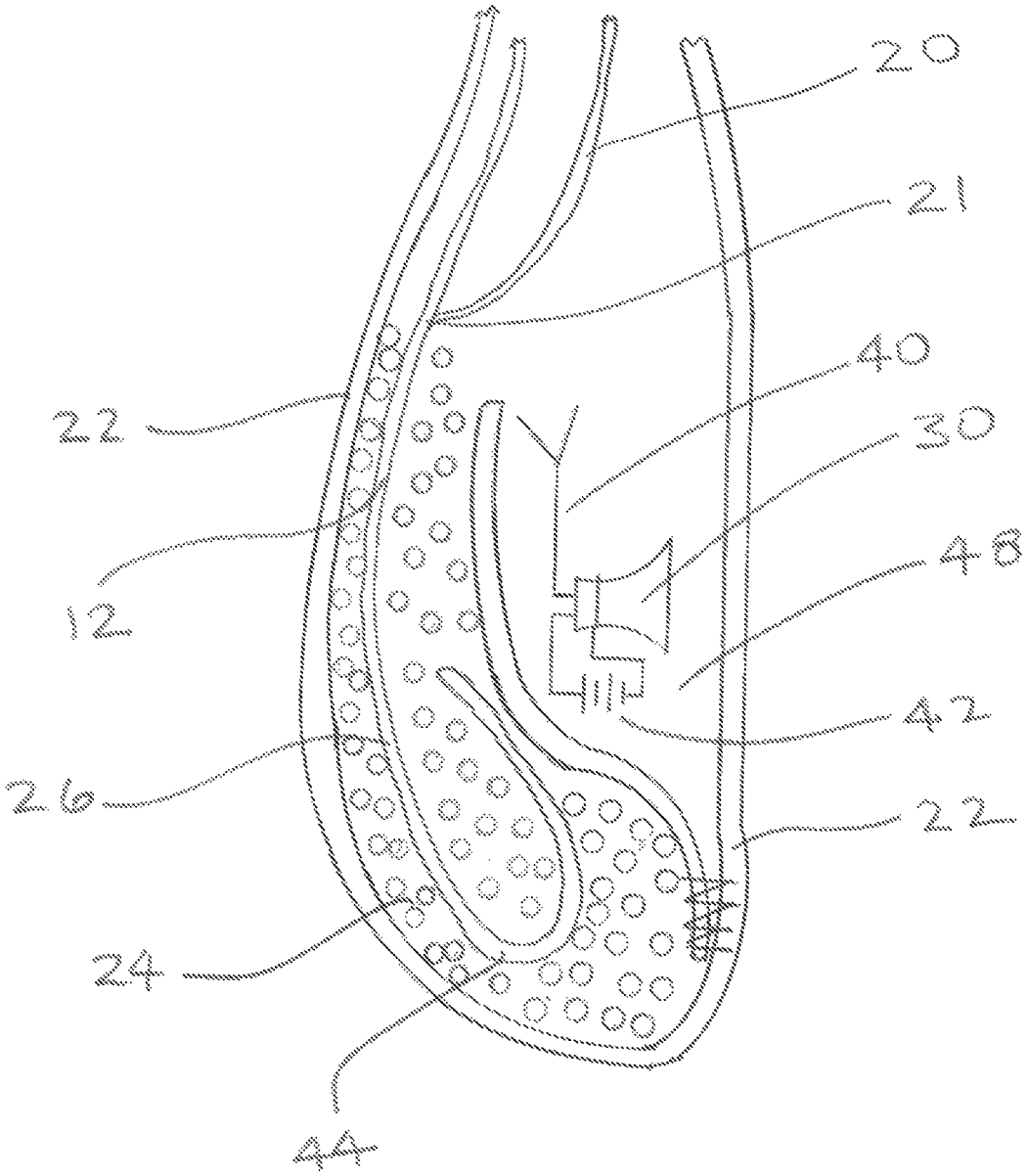
FIG. 4 is a cross sectional view taken at line 4-4 of FIG. 1.

As shown in FIGS. 2 and 4, a layer of resilient, flexible material 24 is positioned between the sheath 22 and the armature 12. Material 24 serves a cushioning function and is advantageously formed of a polymer foam. Material 24 may extend along the entire length of armature 12 as shown in FIGS. 2 and 3 or be confined to regions at the first and second ends 26 and 28 of the armature 12 as shown in FIG. 4 (first end 26 shown).

As shown in FIG. 2, armature 12 supports first and second speakers 30 and 32. In one example embodiment, speakers 30 and 32 further comprise electrical conductors 34, 36, (wires) which connect the speakers 30 and 32 to an electrical connector 38, such as a plug engageable with a standard audio jack. FIG. 4 shows a wireless embodiment, wherein the speakers 30 and 32 (30 shown) comprise a radio frequency receiver 40 and a power source powering the speakers, such as a battery 42. It is anticipated that this embodiment will allow compatibility with Bluetooth wireless technology standards.

As shown in FIG. 2, speakers 30 and 32 are supported by the armature 12 at its opposite ends 26 and 28. To enhance the support function the ends 26 and 28 of armature 12 may be formed into respective first and second loops 44 and 46. The flexible, resilient layer 24 surrounds the loops 44 and 46 to provide cushioning to the wearer when lying down on the headphones 10. To ensure that the speakers 30 and 32 remain at fixed positions within the sheath 22 so that they can be reliably located adjacent to a wearer's ears, the speakers are received within respective first and second pockets 48 and 50. As shown in FIG. 4, pockets 48 and 50 (48 shown) are formed in sheath 22 adjacent to respective loops 44 and 46. To maximize audio transmission the speakers 30 and 32 are positioned between the layer of flexible resilient material 24 and the sheath 22. Hook and loop fasteners may be used to secure pockets 48 and 50 closed, as well as to provide a secure closure to seams in the sheath 22 which, when open, provide access to the interior of the headphones for the placement of speakers or other components.

It is expected that headphones such as example embodiment 10 according to the invention will provide improved comfort to the wearers while still maintaining position securely on the wearer's head even when in contact with pillows or other surfaces.

What is claimed is:

1. Headphones, said headphones comprising:

an elongate, flexible, deformable armature;

an elastic strip attached lengthwise along said armature at a plurality of points in spaced relation to one another along the length of said armature to apply a compressive force to said armature to bias it into a curved configuration;

at least a first speaker supported by said armature.

2. The headphones according to claim 1, wherein said armature comprises a deformable metal core.

3. The headphones according to claim 1, further comprising a sheath surrounding said armature.

4. The headphones according to claim 3, wherein said sheath comprises a flexible substrate.

5. The headphones according to claim 4, wherein said substrate comprises a fabric.

6. The headphones according to claim 3, further comprising a layer of resilient, flexible material positioned between said sheath and said armature.

7. The headphones according to claim 6, wherein said resilient, flexible material comprises a polymer foam.

8. The headphones according to claim 1, wherein said first speaker comprises a wireless receiver and a power source.

9. The headphones according to claim 3, further comprising a second speaker supported by said armature.

10. The headphones according to claim 9, further comprising:

an electrical connector;

first and second electrical conductors connecting said first and second speakers to said electrical connector.

11. The headphones according to claim 9 wherein said armature has first and second ends oppositely disposed, said first speaker being supported by said armature at said first end thereof and said second speaker being supported at said second end thereof.

12. The headphones according to claim 11, wherein said armature forms respective first and second loops at said first and second ends.

13. The headphones according to claim 11, further comprising first and second pockets formed in said sheath, said first and second pockets being respectively positioned adjacent to said first and second ends of said armature, said first speaker being received in said first pocket, said second speaker being received in said second pocket.

14. Headphones for supporting a speaker, said headphones comprising:

an elongate, flexible, deformable armature;

an elastic strip attached lengthwise along said armature at a plurality of points in spaced relation to one another along the length of said armature to apply a compressive force to said armature to bias it into a curved configuration;

a flexible sheath surrounding said armature.

15. The headphones according to claim 14, further comprising a layer of resilient, flexible material positioned between said sheath and said armature.

16. The headphones according to claim 14, further comprising a first speaker supported by said armature.

17. The headphones according to claim 16, wherein said first speaker is supported between a layer of resilient flexible material and said sheath.

18. The headphones according to claim 16, further comprising a second speaker supported by said armature, said first speaker being positioned at a first end of said armature, said second speaker being positioned at a second end of said armature.

19. The headphones according to claim 14, wherein said armature forms respective first and second loops at respective first and second ends of said armature.

20. The headphones according to claim 14, further comprising first and second pockets formed in said sheath, said first and second pockets being respectively positioned adjacent to respective first and second ends of said armature.

* * * * *